United States Patent [19]

Pracht et al.

[11] 4,082,678

[45] Apr. 4, 1978

[54] FABRIC CONDITIONING ARTICLES AND PROCESS

[75] Inventors: Hans Joachim Pracht, Osthofen, Germany; Louis Fay Wong, Fairfield, Ohio

[73] Assignee: The Procter & Gamble Company, Cincinnati, Ohio

[21] Appl. No.: 740,441

[22] Filed: Nov. 10, 1976

[51] Int. Cl.[2] ..... D06M 13/46

[52] U.S. Cl. ..... 252/8.6; 206/.5; 252/8.8; 427/242

[58] Field of Search ..... 252/8.6, 8.8, 316; 206/.5, 219, 524.7, 568; 427/242

[56] References Cited

U.S. PATENT DOCUMENTS

| | | | |
|---|---|---|---|
| 2,236,061 | 3/1941 | Izard et al. | 8/DIG. 10 |
| 3,041,289 | 6/1962 | Katchen et al. | 206/524.7 |
| 3,456,051 | 7/1969 | Mima et al. | 252/316 UX |
| 3,854,981 | 12/1974 | Schon et al. | 252/316 UX |
| 3,896,033 | 7/1975 | Grimm | 252/8.6 |

FOREIGN PATENT DOCUMENTS

| | | |
|---|---|---|
| 98,403 | 1974 | Japan. |

*Primary Examiner*—William E. Schulz

*Attorney, Agent, or Firm*—Douglas C. Mohl; Richard C. Witte

[57] ABSTRACT

Fabric conditioning articles comprising a receptacle releasably containing an agent for making an inner receptacle water insoluble/indispersible which is normally water soluble/dispersible, the inner receptacle containing a fabric conditioning composition. Methods of using the conditioning articles are also provided.

25 Claims, No Drawings

FABRIC CONDITIONING ARTICLES AND PROCESS

BACKGROUND OF THE INVENTION

The present invention relates to articles and methods for supplying conditioning benefits to fabrics in an automatic clothes washer and dryer. The articles comprise a receptacle releasably containing a fabric conditioning composition.

The home laundering operation can provide an opportunity to treat fabrics being laundered with a variety of materials which impart some desirable benefit or quality to the fabrics during laundering. At each stage of the laundering operation (presoaking, washing, rinsing, drying) fabrics are, to varying degrees, found in contact with water which can provide the medium for delivery of fabric conditioning agents.

Delivery of fabric conditioning agents to fabrics during the laundering operation is not, however, accomplished without certain difficulties. Surfactants are generally employed during the presoaking and washing steps for the purpose of removing materials (soil) from the fabrics. Simultaneous deposition onto fabrics of fabric conditioning agents can, therefore, prove troublesome. While some of these problems can be overcome by conditioning fabrics in the automatic dryer (see, for example, Gaiser; U.S. Pat. No. 3,442,692, issued May 6, 1969), it is nevertheless exceptionally difficult to achieve efficient deposition in the dryer of all fabric conditioning agents. For example, it is difficult for dryer added fabric softener/antistat compositions to match the softening performance of rinse added softeners.

Attempts have been made to improve the efficiency of conditioning agent fabric deposition during the laundering process. Some of the attempts are found in the prior art references listed subsequently herein. In spite of these developments, there is a continuing need for methods and compositions which are suitable for efficiently and effectively delivering conditioning agents to fabrics during the home laundering operation.

The present invention is based on the discovery that fabrics can receive excellent conditioning benefits from an article releasably containing a conditioning composition while being treated in an automatic clothes washer and dryer. Superior conditioning benefits are achieved while offering significant additional convenience.

Accordingly, it is an object of the present invention, therefore, to provide articles which can be added to a clothes washer to condition fabrics in a superior manner concurrently with a washer and dryer operation. The articles are constructed such that the fabric conditioning composition is not released until the rinse cycle of the clothes washer or during the drying cycle of a clothes dryer. This release pattern, for example, when the composition contains a fabric softener/antistat, provides for softness equivalent to a rinse added softener and static control equivalent to a dryer added fabric softener.

It is a further object herein to provide methods for conditioning fabrics during the home laundering process.

These and other objects will become obvious from the following disclosure.

DESCRIPTION OF THE PRIOR ART

U.S. Pat. No. 3,822,145, Liebowitz et al., FABRIC SOFTENING, issued July 2, 1974, relates to the use of spherical materials as fabric softening agents. U.S. Pat. Nos. 3,743,534, Zamora et al., PROCESS FOR SOFTENING FABRICS IN A DRYER, issued July 3, 1973; U.S. Pat. No. 3,698,095, Grand et al., FIBER CONDITIONING ARTICLE, issued Oct. 17, 1972; U.S. Pat. No. 3,686,025, Morton, TEXTILE SOFTENING AGENTS IMPREGNATED INTO ABSORBENT MATERIALS, issued Aug. 22, 1972; U.S. Pat. No. 3,676,199, Hewitt et al., FABRIC CONDITIONING ARTICLE AND USE THEREOF, issued July 11, 1972; U.S. Pat. No. 3,633,538, Hoeflin, SPHERICAL DEVICE FOR CONDITIONING FABRICS IN DRYER, issued Jan. 11, 1972; U.S. Pat. No. 3,624,947, Furgal, COATING APPARATUS, issued Jan. 18, 1972; U.S. Pat. No. 3,632,396, Zamora, DRYER-ADDED FABRIC-SOFTENING COMPOSITIONS, issued Jan. 4, 1972; U.S. Pat. No. 3,442,692, Gaiser, METHOD OF CONDITIONING FABRICS, issued May 6, 1969; and U.S. Pat. No. 3,947,971, Bauer, FABRIC SOFTENER AND DISPENSER, issued Apr. 6, 1976, each relate to articles and methods for conditioning fabrics in automatic dryers. U.S. Pat. No. 3,594,212, Ditsch, TREATMENT OF FIBROUS MATERIALS WITH MONTMORILLONITE CLAYS AND POLYAMINES AND POLYQUATERNARY AMMONIUM COMPOUNDS relates to the treatment of fibrous materials with clays and amine or ammonium compounds.

Granular detergent compositions containing fabric conditioning materials are disclosed in U.S. Pat. No. 3,862,058, Nirschl et al., DETERGENT COMPOSITIONS CONTAINING A SMECTITE-TYPE CLAY AND SOFTENING AGENT, issued Jan. 21, 1975, and U.S. Pat. No. 3,861,870, Edwards et al., FABRIC SOFTENING COMPOSITIONS CONTAINING WATER INSOLUBLE PARTICULATE, issued Jan. 21, 1975.

SUMMARY OF THE INVENTION

The instant invention is based on the discovery that superior fabric conditioning articles can be prepared by releasably placing an effective amount of a fabric conditioning composition into a closed receptacle having at least a part of one wall made of a water soluble/dispersible material and enclosing this receptacle and an amount sufficient to insolubilize/make indispersible the receptacle of an electrolyte and/or a pH control agent within an outer flexible receptacle having at least a part of one wall made of a water soluble/dispersible or porous material.

In its process aspect, this invention encompasses a process for conditioning fabrics comprising combining an article of the type disclosed above with a load of fabrics in a clothes washer and leaving the article with the fabrics through the rinse cycle of the washer and the drying cycle of an automatic clothes dryer. Alternatively, the article may remain with the fabrics through all the cycles of an automatic washer and be discarded at the end of that time if an automatic dryer is not used and the fabrics are air dried.

DETAILED DESCRIPTION OF THE INVENTION

The articles herein comprise multiple components each of which is described, in turn, below.

OUTER RECEPTACLE

The outside receptacle which holds the inner receptacle and the pH control agent and/or electrolyte in the present invention is a closed, flexible article wherein at least a part of one wall is constructed of a material which is either solubilized or dispersed in the wash bath solution of a clothes washer or not being soluble/dispersible is sufficiently porous to allow for the release of the buffering agent and/or electrolyte during the wash cycle and the fabric conditioning composition during the rinse cycle and in the dryer. The remainder of the receptacle can then be any water insoluble and nonporous material.

The soluble material can be any material which is sufficiently soluble or dispersible in the wash bath solution so that the pH control agent and/or electrolyte is released into the wash solution and the fabric conditioning composition is released into the rinse solution of the washer. Such materials are generally polymeric and have molecular weights in the range of from about 2,000 to about 200,000. The thickness of the layer is not critical but is generally from about 0.5 mil to about 10 mil.

Examples of suitable polymers include polyethylene oxide, cellulose derivatives such as methylhydroxy propyl cellulose, polyvinyl pyrrolidone and polyvinyl alcohol, among many others. These materials are capable of containing the electrolyte/pH control agent and the inner receptacle while yet being solubilized/dispersed when placed in contact with the wash bath solution. Therefore, in addition to the above-listed materials, any material which can provide a protective film for the receptacle's contents and yet be solubilized/dispersed is suitable for use herein.

Since it is desirable to make the articles herein as aesthetically pleasing as possible and inasmuch as the articles are to be used in a clothes washer and an automatic clothes dryer, it is preferred that the soluble/dispersible-porous wall(s) of the outer receptable be comprised of a heat resistant and water insoluble material. Therefore, the receptacle herein preferably can be made of any materials meeting these requirements. The wall can be made, for example, of porous materials such as open weave cotton, polyester, and the like, cloth or foams.

In a more preferred outer receptacle herein, the porous wall or walls is an elastic, open cell foam or elastic nonwoven material. The open cell foams are distinguished from closed cell foams in that the closed cell structure substantially isolates the individual cells while the open cell structure does not. Regardless of what material is used, it should not inhibit the release of the receptacle's contents.

Open cell foams can be made from polystyrene, polyurethane, polyethylene, poly-(vinyl chloride) cellulose acetate, phenolformaldehyde and other materials such as cellular rubber. Many of these materials and their method of manufacture are disclosed in standard references such as *Encyclopedia of Polymer Science and Technology,* Interscience Publishers, John Wiley & Sons, Inc. (1965), incorporated herein by reference.

The preferred nonwoven cloth materials used herein can generally be defined as adhesively bonded fibrous or filamentous products having a web or carded fiber structure (where the fiber strength is suitable to allow carding), or comprising fibrous mats in which the fibers or filaments are distributed haphazardly or in random array (i.e., an array of fibers in a carded web wherein partial orientation of the fibers is frequently present, as well as a completely haphazard distributional orientation), or substantially aligned. The fibers or filaments can be natural (e.g., wool, silk, jute, hemp, cotton, linen, sisal, or ramie) or synthetic (e.g., rayon, cellulose ester, polyvinyl derivatives, poly-olefins, polyamides, or polyesters). Preferred materials include polyesters, polyamides, poly-olefins and polyvinyl derivatives and mixtures of these with rayon or cotton to achieve the desired elasticity.

Methods of making nonwoven cloths are not a part of this invention and, being well known in the art, are not described in detail herein. Generally, however, such cloths are made by air- or water-laying processes in which the fibers or filaments are first cut to desired lengths from long strands, passed into a water or air stream, and then deposited onto a screen through which the fiber-laden air or water is passed. The deposited fibers or filaments are then adhesively bonded together, dried, cured, and otherwise treated as desired to form the nonwoven cloth. Nonwoven cloths made of polyesters, polyamides, vinyl resins, and other thermoplastic fibers can be spun-bonded, i.e., the fibers are spun out onto a flat surface and bonded (melted) together by heat or by chemical reactions.

Especially preferred materials for preparing the abovedescribed layer of the article herein are open pore polyurethane foams and spun-bonded nonwoven cloths, especially those made from polyesters. The polyurethane foams preferably have a density of from about 0.02 g/cm$^3$ to about 0.04 g/cm$^3$ while the polyester has a basis weight of about 10 g/sq.yd. to 90 g/sq.yd. The thickness of this layer can vary depending on the aesthetic properties desired by the manufacturer, but will preferably be from about 0.2 cm to about 4 cm for polyurethane and from about 0.01 cm to about 6 cm for polyester. The air permeability of the porous wall need only provide sufficient porosity to allow for the release of the fabric conditioning composition but is preferably in the range of 700 to 1400 cubic feet per minute per square foot of surface. The air permeability is measured according to ASTM Method D737-69, "Standard Method of Test for Air Permeability of Textile Fabrics."

It is also within the scope of the present invention to provide articles wherein the outer receptacle is made of more than one layer of the above-described materials. For example, two layers of nonwoven polyester may be selected to provide articles having an appearance which connotes optimum fabric conditioning.

PH CONTROL AGENT AND/OR ELECTROLYTE

Achieving the superior fabric conditioning performance described hereinbefore is dependent on the fabric conditioning composition not being released until the rinse cycle of the clothes washer and during the drying cycle of the clothes dryer. As a result of this release pattern, the consumer can have the convenience of putting the article in with the fabrics to be washed at the start of the wash cycle while obtaining, for example, softening/antistatic performance which is superior to that delivered by rinse cycle or dryer added softeners-/antistats.

The insolubility of the inner receptacle of the articles during the wash cycle is achieved by the maintaining of a sufficiently high electrolyte level and/or proper pH in the wash solution. The electrolyte level and/or pH are critical since, looking at the former first, the electrolyte either through a chemical reaction or salting out mechanism causes the inner receptacle material to gel and, hence, be water insoluble. Once the electrolyte level drops below the gelling level (i.e., when the wash water containing the electrolyte is removed and replaced with clean rinse water), the inner receptable can begin to dissolve/disperse, thereby releasing the fabric conditioning composition which is contains. The obtaining of efficient gelling in many instances is dependent on the electrolyte residing in an environment having a pH within a certain range. The pH allows the electrolyte to complex with the inner wall material in the most efficient manner. This is especially true where the electrolyte has an anion which can be protonated. If protonation occurs gelation is hindered. It is necessary in such instances to maintain the pH of the wash solution above the $pK_A$ of the anion.

Many materials are insolubilized solely as the result of pH control. The critical pH is generally thought to be around the isoelectric point and can be achieved through the use of buffering agents. Examples of such agents will be discussed hereinbelow.

The materials which can serve as electrolytes in the present invention are any of those materials which can sufficiently complex or salt out the inner receptacle material to cause it to gel. Examples of suitable agents include but are not limited to sodium borate, sodium metaborate, ammonium sulfate, sodium sulfate, potassium sulfate, zinc sulfate, cupric sulfate, ferrous sulfate, magnesium sulfate, aluminum sulfate, potassium aluminum sulfate, ammonium nitrate, sodium nitrate, potassium nitrate, aluminum nitrate, sodium chloride, potassium chloride, sodium phosphate, potassium chromate, potassium citrate and mixtures thereof.

The amount of electrolyte employed herein is an amount sufficient to gel the inner receptacle. This can be determined by dispersing/dissolving a small amount, for example, about 0.5 grams, of the inner receptacle construction material in a known quantity of about 90° F wash solution and then adding the electrolyte until reversible gelation occurs. This amount can then be increased to maintain the molar concentration of the electrolyte in the wash water at the gelation level. For most washers a water volume of 64 to 83 liters, or on average about 70 liters, is present during the wash cycle. Therefore, the amount of electrolyte to be used in the articles herein should be sufficient to maintain the concentration at the gelation level in 70 liters of water. Thus, if one liter of water is used to determine gelation, the amount of electrolyte for use in the article would be 70 times that amount. The wash bath solutions in which the articles herein are used will contain detergent compositions and these will affect the solubility of the inner receptacle. Therefore, to the liter of water should be added a detergent composition at a concentration equivalent to normal wash conditions. Since there are two basic types of laundry detergents, liquids and granules, two tests should be conducted. In one test about 0.9 ml. of a liquid detergent should be dissolved in the water prior to electrolyte addition and in the other test about 4.5 ml. of a granule detergent should be dissolved. These amounts correspond to ¼ cup of liquid detergent per wash load and 1¼ cup of granules. The amount of electrolyte/pH control agent used in the articles herein is the greater of the two amounts determined to be required for gelation. This amount insures that the article is operable in all types of wash solutions. Of course, it is to be appreciated that the critical factor is the electrolyte concentration in the wash solution and not how it is achieved. (i.e., If more than one article is used the total amount of electrolyte used must be enough to insolubilize or make indispersible both inner receptacles. All of the electrolyte can be present in one article or split between the articles.)

As is true with the electrolyte component of the present invention, the pH control agent can be any of a wide variety of acids, bases and general buffering systems. Included among such materials are citric acid, glycolic acid, tartaric acid, maleic acid, gluconic acid, boric acid, glutamic acid, isophthalic acid, sodium bisulfate, potassium bisulfate, sodium hydroxide, potassium hydroxide and alkali metal and ammonium phosphates, carbonates, borates, bicarbonates, metaborates. A preferred electrolyte/pH control agent is sodium borate and/or sodium metaborate.

The amount of pH control agent used herein is an amount sufficient to insure the insolubility/indispersibility of the inner receptacle. This will vary with the particular material selected but can easily be determined in the manner described above for the electrolyte.

INNER RECEPTACLE

The inner receptacle, as explained herein previously, serves to prevent the fabric conditioning composition from being released to the fabrics until the rinse cycle of the washer and the drying cycle of the dryer. The receptacle thus must have at least a part of one wall which is water soluble/dispersible but is insolubilized during the wash cycle by the maintenance of a sufficient electrolyte level and/or the appropriate pH. Materials which satisfy this requirement are many and will be discussed hereinbelow. The remainder of the receptacle can then be any water insoluble and nonporous material.

It is to be appreciated that the inner receptacle can take any shape or size or actually be many individual receptacles. Exemplifying the latter are particles, either singly or in agglomerated form, of the fabric conditioning composition coated with the material of construction of the inner receptacle. The coating is then the inner receptacle. Such particles can be formed in a variety of ways known in the art (see, for example, U.S. Pat. No. 3,896,033, July 22, 1975, to Grimm III, incorporated herein by reference). Also, the soluble/dispersible portion can be a part of a web wherein said portion fills the holes of the web and the web structure itself is insoluble but porous enough to allow for the release of the conditioning composition.

The materials which can be used to construct the insolubilized/made indispersible portion of the inner receptacle include polyvinyl alcohol, gelatins and other proteins, polyvinyl pyrrolidone, polyethylene oxide, methyl cellulose, hydroxypropyl methyl cellulose, polyfructose, and polysaccharides such as guar gum, among many others. The materials can have a broad range of molecular weights and thicknesses. However, it is preferred that the former be from about 2,000 to about 200,000 and the latter be from about 0.1 mil to about 5 mil. These limitations provide for receptacles which can most effectively dissolve/disperse to release the fabric conditioning composition.

The materials listed above can be grouped by the type of agent required to make the material insoluble or indispersible. Those which are controlled by electrolyte level include polyvinyl alcohol, polyethylene oxide, methyl cellulose, guar gum, and hydroxypropyl methyl cellulose. Those which are controlled by pH include gelatin and other proteins, polyvinyl pyrrolidone and polyfructose.

The preferred materials for use as the inner receptacle are polyvinyl alcohol and gelatins. The polyvinyl alcohol preferably has a degree of hydrolysis of from about 73% to about 100% more preferably about 88%, and a molecular weight of about 2,000 to 130,000, preferably about 90,000. The gelatin materials can be either Type A, isoelectric point of pH 7–9, or Type B, isoelectric point of pH 4.7–5. The gelation of gelatin takes place near the isoelectric point. A detailed discussion of polyvinylalcohol can be found in C. A. Finch (Editor), *Polyvinyl Alcohol — Properties and Applications,* John Wiley & Sons, New York, 1973. Detailed discussions of proteins can be found in H. R. Mahler & E. H. Cordes, *Biological Chemistry,* Harper and Row, New York, 1971, and A. H. Lehninger, *Biochemistry,* Worth Pub., Inc., New York, 1975. Discussions of the previously mentioned cellulose derivatives, polyvinyl pyrollidone and ethylene oxide are found in R. L. Davidson & M. Sittig (Editors), *Water-Soluble Resins,* Van Nostrand Reinhold Company, New York, 1968. A discussion of polysaccharides is found in R. L. Whistler (Editor), *Industrial Gums — Polysaccharides and Their Derivatives,* American Press, New York, 1973. All of these references are incorporated herein by reference.

FABRIC CONDITIONING COMPOSITION

For purposes of the present invention a "fabric conditioning agent" is any substance which improves or modifies the chemical or physical characteristics of the fabric being treated therewith. Examples of suitable fabric conditioning agents include perfumes, elasticity improving agents, flame proofing agents, pleating agents, antistatic agents, softening agents, soil proofing agents, water repellent agents, crease proofing agents, acid repellent agents, antishrinking agents, heat proofing agents, coloring material, brighteners, bleaching agents, fluorescers and ironing aids. These agents can be used alone or in combination.

The most preferred fabric conditioning composition for use in the present invention contains antistatic and softener agents. Such agents provide benefits sought by many consumers and the convenience offered by the present invention would serve them well.

The fabric softener/antistat composition employed herein can contain any of the wide variety of nonionic and cationic materials known to supply these benefits. These materials are substantive, and have a melting point within the range of from about 20° C to about 115° C, preferably within the range of from about 30° C to about 60° C.

The most common type of cationic softener/antistat materials are the cationic nitrogen-containing compounds such as quaternary ammonium compounds and amines having one or two straight-chain organic groups of at least eight carbon atoms. Preferably, they have one or two such groups of from 12 to 22 carbon atoms. Preferred cation-active softener compounds include the quaternary ammonium softener/antistat compounds corresponding to the formula

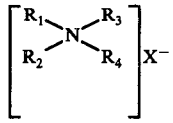

wherein $R_1$ is hydrogen or an aliphatic group of from 1 to 22 carbon atoms; $R_2$ is an aliphatic group having from 12 to 22 carbon atoms; $R_3$ and $R_4$ are each alkyl groups of from 1 to 3 carbon atoms; and X is an anion selected from halogen, acetate, phosphate, nitrate and methyl sulfate radicals.

Because of their excellent softening efficacy and ready availability, preferred cationic softener/antistat compounds of the invention are the dialkyl dimethyl ammonium chlorides, wherein the alkyl groups have from 12 to 22 carbon atoms and are derived from long-chain fatty acids, such as hydrogenated tallow. As employed herein, alkyl is intended as including unsaturated compounds such as are present in alkyl groups derived from naturally occurring fatty oils. The term "tallow" refers to fatty alkyl groups derived from tallow fatty acids. Such fatty acids give rise to quaternary softener compounds wherein $R_1$ and $R_2$ have predominantly from 16 to 18 carbon atoms. The term "coconut" refers to fatty acid groups from coconut oil fatty acids. The coconut-alkyl $R_1$ and $R_2$ groups have from about 8 to about 18 carbon atoms and predominate in $C_{12}$ to $C_{14}$ alkyl groups. Representative examples of quaternary softeners of the invention include tallow trimethyl ammonium chloride; ditallow dimethyl ammonium chloride; ditallow dimethyl ammonium methyl sulfate; dihexadecyl dimethyl ammonium chloride; di(hydrogenated tallow) dimethyl ammonium chloride; dioctadecyl dimethyl ammonium chloride; dieicosyl dimethyl ammonium chloride; didocosyl dimethyl ammonium chloride; di(hydrogenated tallow) dimethyl ammonium methyl sulfate; dihexadecyl diethyl ammonium chloride; dihexadecyl dimethyl ammonium acetate; ditallow dipropyl ammonium phosphate; ditallow dimethyl ammonium nitrate; di(coconut-alkyl) dimethyl ammonium chloride.

An especially preferred class of quaternary ammonium softener/antistats of the invention correspond to the formula

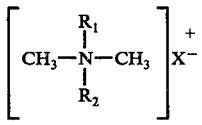

wherein $R_1$ and $R_2$ are each straight chain aliphatic groups of from 12 to 22 carbon atoms and X is halogen, e.g., chloride or methyl sulfate. Especially preferred are ditallow dimethyl ammonium methyl sulfate (or chloride) and di(hydrogenated tallow-alkyl) dimethyl ammonium methyl sulfate (or chloride) and di(coconut-alkyl) dimethyl ammonium methyl sulfate (or chloride), these compounds being preferred from the standpoint of excellent softening properties and ready availability.

Suitable cation-active amine softener/antistat compounds are the primary, secondary and tertiary amine compounds having at least one straight-chain organic group of from 12 to 22 carbon atoms and 1,3-propylene diamine compounds having a straight-chain organic group of from 12 to 22 carbon atoms. Examples of such softener actives include primary tallow amine; primary hydrogenated-tallow amine; tallow 1,3-propylene diamine; oleyl 1,3-propylene diamine; coconut 1,3-propylene diamine; soya 1,3-propylene diamine and the like.

Other suitable cation-active softener/antistat compounds herein are the quaternary imidazolinium salts. Preferred salts are those conforming to the formula

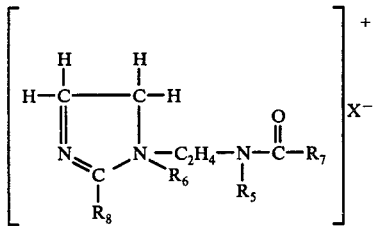

wherein $R_6$ is an alkyl containing from 1 to 4, preferably from 1 to 2 carbon atoms, $R_5$ is an alkyl containing from 1 to 4 carbon atoms or a hydrogen radical, $R_8$ is an alkyl containing from 1 to 22, preferably at least 15 carbon atoms or a hydrogen radical, $R_7$ is an alkyl containing from 8 to 22, preferably at least 15 carbon atoms, and X is an anion, preferably methylsulfate or chloride ions. Other suitable anions include those disclosed with reference to the cationic quaternary ammonium fabric softener/antistats described hereinbefore. Particularly preferred are those imidazolinium compounds in which both $R_7$ and $R_8$ are alkyls of from 12 to 22 carbon atoms, e.g., 1-methyl-1-[(stearoylamide)ethyl]-2-heptadecyl-4,5-dihydroimidazolinium methyl sulfate; 1-methyl-1-[(palmitoylamide)ethyl]-2-octadecyl-4,5-dihydroimidazolinium chloride and 1-methyl-1-[(tallowamide) ethyl]-2-tallow-imidazolinium methyl sulfate.

Other cationic quaternary ammonium fabric softener/antistats which are useful herein include, for example, alkyl ($C_{12}$ to $C_{22}$)-pryidinium chlorides, alkyl ($C_{12}$ to $C_{22}$)-alkyl ($C_1$ to $C_3$)-morpholinium chlorides and quaternary derivatives of amino acids and amino esters.

Nonionic fabric softener/antistat materials include a wide variety of materials including sorbitan esters, fatty alcohols and their derivatives, diamine compounds and the like. One preferred type of nonionic fabric antistat/-softener material comprises the esterified cyclic dehydration products of sorbitol, i.e., sorbitan ester. Sorbitol, itself prepared by catalytic hydrogenation of glucose, can be dehydrated in well-known fashion to form mixtures of cyclic 1,4- and 1,5-sorbitol anhydrides and small amounts of isosorbides. (See Brown; U.S. Pat. No. 2,322,821; issued June 29, 1943) The resulting complex mixtures of cyclic anhydrides of sorbitol are collectively referred to herein as "sorbitan". It will be recognized that this "sorbitan" mixture will also contain some free uncyclized sorbitol.

Sorbitan ester fabric softener/antistat materials useful herein are prepared by esterifying the "sorbitan" mixture with a fatty acyl group in standard fashion, e.g., by reaction with a fatty ($C_{10}$-$C_{24}$) acid or fatty acid halide. The esterification reaction can occur at any of the available hydroxyl groups, and various mono-, di-, etc., esters can be prepared. In fact, complex mixtures of mon-, di-, tri-, and tetra-esters almost always result from such reactions, and the stoichiometric ratios of the reactants can simply be adjusted to favor the desired reaction product.

The foregoing complex mixtures of esterified cyclic dehydration products are sorbitol (and small amounts of esterified sorbitol) are collectively referred to herein as "sorbitan esters". Sorbitan mono- and di-esters of lauric, myristic, palmitic, stearic and behenic acids are particularly useful herein for conditioning the fabrics being treated. Mixed sorbitan esters, e.g., mixtures of the foregoing esters, and mixtures prepared by esterifying sorbitan with fatty acid mixtures such as the mixed tallow and hydrogenated palm oil fatty acids, are useful herein and are economically attractive. Unsaturated $C_{10}$-$C_{18}$ sorbitan esters, e.g., sorbitan mono-oleate, usually are present in such mixtures. It is to be recognized that all sorbitan esters, and mixtures thereof, which are essentially water-insoluble and which have fatty hydrocarbyl "tails", are useful fabric softener/antistat materials in the context of the present invention.

The preferred alkyl sorbitan ester fabric softener/antistat materials herein comprise sorbitan monolaurate, sorbitan monomyristate, sorbitan monopalmitate, sorbitan monostearate, sorbitan monobehenate, sorbitan dilaurate, sorbitan dimyristate, sorbitan dipalmitate, sorbitan distearate, sorbitan dibehenate, and mixtures thereof, the mixed coconutalkyl sorbitan mono- and di-esters and the mixed tallowalkyl sorbitan mono- and di-esters. The tri- and tetra-esters of sorbitan with lauric, myristic, palmitic, stearic and behenic acids, and mixtures thereof, are also useful herein.

Another useful type of nonionic fabric softener/antistat material encompasses the substantially water-insoluble compounds chemically classified as fatty alcohols. Mono-ols, di-ols, and poly-ols having the requisite melting points and water-insolubility properties set forth above are useful herein. Such alcohol-type fabric conditioning materials also include the mono- and di-fatty glycerides which contain at least one "free" OH group.

All manner of water-insoluble, high melting alcohols (including mono- and di-glycerides), are useful herein, inasmuch as all such materials are fabric sustantive. Of course, it is desirable to use those materials which are colorless, so as not to alter the color of the fabrics being treated. Toxicologically acceptable materials which are safe for use in contact with skin should be chosen.

A preferred type of unesterified alcohol useful herein includes the higher melting members of the so-called fatty alcohol class. Although once limited to alcohols obtained from natural fats and oils, the term "fatty alcohols" has come to mean those alcohols which correspond to the alcohols obtainable from fats and oils, and all such alcohols can be made by synthetic processes. Fatty alcohols prepared by the mild oxidation of petroleum products are useful herein.

Another type of material which can be classified as an alcohol and which can be employed as the fabric softener/antistat material in the instant invention encompasses various esters of polyhydric alcohols. Such "ester-alcohol" materials which have a melting point within the range recited herein and which are substantially water-insoluble can be employed herein when they contain at least one free hydroxyl group, i.e., when they can be classified chemically as alcohols.

The alcoholic di-esters of glycerol useful herein include both the 1,3-di-glycerides and the 1,2-di-glycerides. In particular, di-glycerides containing two $C_8$–$C_{20}$, preferably $C_{10}$–$C_{18}$, alkyl groups in the molecule are useful fabric conditioning agents.

Non-limiting examples of ester-alcohols useful herein include: glycerol-1,2-dilaurate; glycerol-1,3-dilaurate; glycerol-1,2-dimyristate; glycerol-1,3-dimyristate; glycerol-1,2-dipalmitate; glycerol-1,3-dipalmitate; glycerol-1,2-distearate and glycerol-1,3-distearate. Mixed glycerides available from mixed tallowalkyl fatty acids, i.e., 1,2-ditallowalkyl glycerol and 1,3-ditallowalkyl glycerol, are economically attractive for use herein. The foregoing ester-alcohols are preferred for use herein due to their ready availability from natural fats and oils.

Mono- and di-ether alcohols, especially the $C_{10}$–$C_{18}$ di-ether alcohols having at least one free —OH group, also fall within the definition of alcohols useful as fabric softener/antistat materials herein. The ether-alcohols can be prepared by the classic Williamson ether synthesis. As with the ester-alcohols, the reaction conditions are chosen such that at least one free, unetherified —OH group remains in the molecule.

Ether-alcohols useful herein include glycerol-1,2-dilauryl ether; glycerol-1,3-distearyl ether; and butane tetra-ol-1,2,3-trioctanyl ether.

Yet another type of nonionic fabric conditioning agent useful herein encompasses the substantially water-insoluble (or dispersible) diamine compounds and diamine derivatives. The diamine fabric conditioning agents are selected from the group consisting of particular alkylated or acylated diamine compounds.

Useful diamine compounds have the general formula $$R_1-\overset{\overset{\displaystyle R_2}{|}}{N}-(CH_2)_n-\overset{\overset{\displaystyle R_3}{|}}{N}-R_4$$

wherein $R_1$ is an alkyl or acyl group containing from about 12 to 20 carbon atoms; $R_2$ and $R_3$ are hydrogen or alkyl of from about 1 to 20 carbon atoms and $R_4$ is hydrogen, $C_{1-20}$ alkyl or $C_{12-20}$ acyl. At least two of $R_2$, $R_3$ and $R_4$ are hydrogen or alkyl containing 1 to 3 carbon atoms, and $n$ is from 2 to 6.

Non-limiting examples of such alkylated diamine compounds include:

$C_{15}H_{33}$ — $N(CH_3)$ — $(CH_2)_3$—$N(CH_3)_2$
$C_{18}H_{37}$—$N(CH_3)$—$(CH_2)_2$—$N(C_2H_5)_2$
$C_{12}H_{25}$—$N(CH_3)$—$(CH_2)_3$—$HN$—$C_{12}H_{25}$
$C_{12}H_{25}$—$N(C_2H_5)$—$(CH_2)_3$—$N(C_3H_7)_2$
$R_{Tallow}NH$—$(CH_2)_3$—$N(C_2H_5)_2$
$C_{20}H_{41}$—$N(CH_3)$—$(CH_2)_2$—$N(CH_3)_2$
$C_{15}H_{31}$—$N(C_2H_5)$—$(CH_2)_3$—$NH_2$
$C_{18}H_{37}$—$NH$—$(CH_2)_3$—$HN$—$CH_3$
$C_{16}H_{33}$—$NH$—$(CH_2)_3$—$HN$—$C_{16}H_{33}$
$R_{Tallow}N(CH_3)$—$(CH_2)_3$—$N(C_2H_5)_2$
$C_{16}H_{33}N(CH_3)$—$(CH_2)_5$—$N(C_2H_5)_2$
$C_{12}H_{25}N(C_2H_5)$—$(CH_2)_2$—$N(C_3H_7)_2$ and
$C_{14}H_{29}N(CH_3)$—$(CH_2)_3$—$(CH_3)N$—$C_8H_{17}$ wherein in the above formulas $R_{Tallow}$ is the alkyl group derived from tallow fatty acid.

Other examples of suitable aklyated diamine compounds include N-tetradecyl, N'-propyl-1,3-propanediamine, N-eicosyl,N,N',N'-triethyl-1,2-ethane-diamine and N-octadecyl,N,N',N'-tripropyl-1,3-propane-diamine.

Examples of suitable acylated diamine fabric softener/antistat materials include $C_{13-20}$ amido amine derivatives.

The fabric softener/antistats mentioned above can be used singly or in combination in the practice of the present invention.

Preferred mixtures useful herein are mixtures of dialkyl dimethyl ammonium salts with imidazolinium salts and mixtures of these two materials with sorbitan esters. An especially preferred mixture includes ditallow dimethyl ammonium methyl sulfate and 1-methyl-1-[(tallowamide)ethyl]-2-tallow imidazolinium methyl sulfate in a ratio of from about 65:35 to about 35:65 and sorbitan tristearate in a ratio of from about 50:50 to about 5:95, sorbitan tristearate to the sum of the other two agents. Tallow alcohol or hydrogenated castor oil may be used to replace sorbitan tristearate in the above mixture with similar results being obtained. Another especially preferred mixture includes the above mixture wherein the sorbitan tristearate is absent and the other two components are present in a ratio of from about 65:35 to 35:65.

Another class of desirable fabric conditioning agents used in the articles herein are bleaches. These include the common inorganic peroxy compounds such as alkali metal and ammonium perborates, percarbonates, monopersulfates and monoperphosphates. Solid organic peroxy acids, or the water-soluble, e.g., alkali metal, salts thereof of the general formula $$HO-O-\overset{\overset{\displaystyle O}{\|}}{C}-R-YH$$

wherein R is a substituted or unsubstituted alkylene or arylene group and Y is $$-\overset{\overset{\displaystyle O}{\|}}{C}-O-O-,\ -\overset{\overset{\displaystyle O}{\|}}{\underset{\underset{\displaystyle O}{\|}}{S}}-O \text{ or } -\overset{\overset{\displaystyle O}{\|}}{C}-O-$$

or any other group which yields an anionic group in aqueous solution are also useful herein. These bleaches are more fully described in U.S. Pat. No. 3,749,673, July 31, 1973, Jones et al., incorporated herein by reference.

OPTIONAL COMPONENTS

In a preferred article herein the fabric conditioning composition is a softener/antistat composition in the form of a free flowing powder. To facilitate forming such a powder any of a wide variety of filler materials may be used in the present composition. Such fillers include inorganics such as sodium sulfate, calcium carbonate, aluminum oxide and smectite clays and organics such as high molecular weight polyethylene glycols. Smectite clays and aluminum oxide are preferred fillers herein since they may additionally help in insolubilizing the inner receptacle. A description of smectite clays may be found in U.S. Pat. No. 3,862,058, Jan. 21, 1975, to Nirschl et al., incorporated herein by reference. The filler material may be present at a level ranging from about 5% to 35% by weight of the softener/antistat composition.

The fabric softening/antistat compositions herein can also optionally contain minor proportions (i.e., 0.1% to about 15% by weight of various other ingredients which provide additional fabric conditioning benefits. Such optional ingredients include perfumes, fumigants, bactericides, fungicides, optical brighteners and the like. Specific examples of typical solid, water-soluble additives useful herein can be found in any current Year Book of the American Association of Textile Chemists and Colorists. Such additional components can be selected from those compounds which are known to be compatible with the softener/antistat agents employed herein, or can be coated with water-soluble coatings such as solid soaps, and the like, and thereby rendered compatible.

A preferred optional ingredient is a fabric substantive perfume material. Included among such perfume materials are musk ambrette, musk ketone, musk xylol, ethyl vanillin, musk tibertine, coumarin, aurantiol and mixtures thereof. The above perfumes are preferably used in an amount of from about 0.1% to about 5% by weight of the fabric softener/antistat composition.

The water-soluble silicate materials recognized in the art as corrosion inhibitors can be employed in the present compositions at levels of about 5% by weight.

Release aids such as nonionic surfactants can also be advantageously employed in the present invention.

It will be recognized that any of the foregoing types of optional components can be provided in a solid, particulate form which can be dispensed onto the fabrics concurrently with the fabric softener/antistat to provide the desired additional fabric treatment benefits.

PREPARATION AND USAGE

The articles of the present invention are prepared by fashioning a receptacle of the type hereinbefore described and enclosing therein an effective amount of the fabric conditioning composition. By an "effective amount" of the fabric conditioning composition herein is meant an amount sufficient to condition an average load of fabrics in an automatic washer/dryer. Of course, the actual amount of the fabric conditioning composition employed will depend on the fabric load and the particular composition selected for use in the article. For example, when an average 5 lbs. to 8 lbs. load of fabrics is being treated, from about 1 gram to 12, preferably 1 to 6, grams of any of the foregoing softener/antistat compositions provide good fabric conditioning. The lower level is acceptable for use herein due to the ability of the articles of this invention to protect the conditioning agent from being lost during the washing process.

The fabric conditioning composition preferably takes the form of a solid or more preferably a free flowing granular composition. The granules will be of a slightly smaller size than the openings in the porous layer(s) of an outer receptacle herein. Fabric conditioning compositions having an average diameter below about 150 microns and preferably falling in the range of from about 40 microns to about 120 microns are preferred for use herein. Particles of such size of, for example, a fabric softener/antistat composition can be easily released from the article during the rinse cycle and in the dryer to provide softness and static control.

The receptacle herein can be provided in a variety of sizes and shapes and the particular configuration of the receptacle is not critical to the practice of this invention. For example, the receptacle herein can be provided wherein only one wall, or a portion of one wall, of the inner receptacle or outer receptacle comprises the materials described previously herein. Preferably the whole of the receptacles comprise the described materials.

In its simplest and preferred aspect, the article herein is prepared in the shape of a pouch. Preferred articles herein comprise an inner receptacle of polyvinyl alcohol. The outer receptacle in the preferred articles comprises a nonwoven polyester cloth having an air permeability of from about 700 to about 1400 cubic feet per minute per square foot. The outer receptacle is formed by sealing three edges of the material by heat or sonic sealing, leaving an opening along one edge. The inner receptacle is similarly formed with the fabric conditioning composition being added and the fourth edge sealed. The inner receptacle and the electrolyte and/or pH control agent are added to the outer receptacle which then has its fourth edge sealed.

As was noted hereinbefore, the size of the present articles is not critical and can be whatever the manufacturer desires. For ease of handling, however, it is preferred that the outer receptacle be from about 2 inches $\times$ 3 inches to about 4 inches $\times$ 6 inches. The inner receptacle preferably is from about 1 inch $\times$ 2 inches to about 3 inches $\times$ 4 inches.

The preferred buffer/electrolyte for use with the polyvinyl alcohol inner receptacle is a sodium borate or sodium borate/metaborate system sufficient to provide a molar boron concentration of from about $1 \times 10^{-3}$ to about $2 \times 10^{-2}$ and a pH greater than 8.5, preferably 9.0–9.5 in the wash water.

USAGE

The articles of the present invention can be utilized in a variety of ways depending on the desires of the user. In a preferred process, an article prepared as described herein is placed in with a load of fabrics at the start of the wash cycle in a standard clothes washer and left with the fabrics through the entire wash, rinse and spin drying cycles. The temperature of the wash and rinse waters can be any temperatures desired by the user, but generally are in the range of from about 4° C to about 60° C. The article then remains with the damp fabrics when they are placed in the drum of an automatic clothes dryer, if a dryer is used. The dryer is operated in standard fashion to dry the fabrics, usually at a temperature from about 50° C to about 80° C for a period of from about 10 to about 60 minutes, depending on the fabric load and type. Alternatively, the articles herein can be combined with the fabrics at the start of the wash cycle and removed with the fabrics at the end of the rinse cycle when a dryer is not used.

The detergent composition which can be used to wash the fabrics during the above-described wash cycle can be any conventional detergent composition. Such a composition generally contains from about 1% to about 50% of a detersive surfactant. The detergents may be liquid or solid and contain other components such as a detergency builder, bleaches, enzymes, among other detergency adjuvants. The surfactants which may be used include any of the common anionic, nonionic, ampholytic and zwitterionic detersive agents well known in the detergency arts. Mixtures of surfactants may also be used. Examples of surfactants are given in U.S. Pat. Nos. 3,717,630, Booth, Feb. 20, 1973, and 4,443,880, Kessler et al., July 25, 1967, each incorporated herein by reference.

The detergency builder salts which are oftentimes utilized in detergent compositions include both inorganic, as well as organic, water-soluble builder salts and the various water-insoluble and so-called "seeded" builders. Typical laundry detergent compositions are designed to provide a concentration of builder salt of from about 50 ppm to about 1000 ppm and a concentration of detersive surfactant in the range of 50 ppm to about 1000 ppm. These concentrations are generally met in the average aqueous solutions used to wash fabrics (5–25 gallons). The amount of detergent composition utilized per wash load is familiar to users of laundry products and ranges from about ¼ cup to 1¼ cup.

The performance delivered by the receptacles herein when used as described above is equivalent to a rinse added liquid softener in terms of softness and a dryer added sheet in terms of static control.

All percentages used herein are by weight unless otherwise designated.

The invention will be further illustrated by the following examples:

EXAMPLE I

A pouch of the present invention is made in the following manner:

A. A fabric softener/antistat composition comprising six grams of the composition described below is made as described in Example II

| | |
|---|---|
| Dimethylditallowammonium methylsulfate | 65% |
| 1-methyl-1-[(tallowamide)ethyl)] -2-tallowimidazolinium methyl sulfate | 35 |
| | 100% |

B. A pouch measuring 2 inches × 3 inches is formed from polyvinyl alcohol which is 88% hydrolyzed and of 3 mil thickness. Three edges of the pouch are sealed using an impulse heat sealer, the composition of A is added and the fourth edge is sealed.

C. The pouch of B is added along with 10 grams of sodium borate . decahydrate and 15 grams of sodium metaborate . octahydrate to a pouch measuring 3 inches × 4.5 inches whose walls are made of two layers of polyester nonwoven material, one layer having a basis weight of 20 g/yd$^2$ and the other being air laid and having a basis weight of 45 g/yd$^2$. The polyester materials are bonded together at the edges using an ultrasonic sewing machine.

EXAMPLE II

The granular softener/antistat composition used in Example I is made in the following manner:

A. The ditallowdimethylammonium methylsulfate and the imidazolinium salt are comelted together at 190° F.

B. The mixture of A is sprayed through a fine nozzle and solidifies into a powder containing particles ranging in size from about 5 to 150 microns.

EXAMPLE III

The pouch of Example I is added along with a 5.5 lb. bundle of unsoiled fabrics and 96 grams of an anionic detergent to an automatic washer. The washer is operated for a period of 14 minutes using 100° F temperature water. After the completion of the wash cycle, the rinse and spin dry cycles are completed. Finally, the fabrics and the pouch are transferred to an automatic clothes dryer which is operated for a period of 50 minutes at a normal temperature setting. The dried fabrics demonstrate excellent softness and static control.

EXAMPLE IV

A pouch similar to the pouch of Example I is made except that the fabric softener/antistat composition is the following:

| | |
|---|---|
| Dimethylditallowammonium methylsulfate | 51% |
| 1-methyl-1-[(tallowamide)ethyl)] -2-tallowimidazolinium methyl sulfate | 34 |
| Sorbitan tristearate | 15 |
| | 100% |

EXAMPLE V

A pouch similar to the pouch of Example I is made except that the amount of sodium borate is 5 grams and the amount of sodium metaborate is 15 grams.

EXAMPLE VI

A pouch similar to the pouch of Example I is made except that the fabric softener/antistat composition is the following:

| | |
|---|---|
| Tallowtrimethylammonium methylsulfate | 85% |
| Tallow alcohol | 14 |
| Perfume | 1 |
| | 100% |

EXAMPLE VII

A receptacle of the present invention is made in the following manner:

A. A fabric softener/antistat composition comprising ten grams of the composition described below is made as described in Example II.

| | |
|---|---|
| Dimethylditallowammonium methylsulfate | 52% |
| 1-methyl-1-[(tallowamide)ethyl)] -2-tallowimidazolinium methyl sulfate | 35 |
| Sorbitan tristearate | 10 |
| Perfume | 3 |
| | 100% |

B. A gelatin, having an isoelectric point pH of 8.7, capsule approximately 2 inches in length by ½ inch in diameter is formed and the composition of A is added thereto. The capsule is then sealed with a water-insoluble glue.

C. The capsule of B is added along with 15 grams of sodium silicate to a pouch whose walls are made of a nonwoven polyester material having a basis weight of 45 g/yd$^2$. The polyester material is bonded together at the edges using an ultrasonic sewing machine.

What is claimed is:

1. A fabric conditioning article especially designed for conditioning fabrics in a clothes washer comprising:
   (A) a closed receptacle, at least a part of one wall of said receptacle comprising a water soluble/dispersible material;
   (B) an effective amount of a fabric conditioning composition, said composition being contained within the receptacle of (A);
   (C) an amount of an agent selected from the group consisting of electrolytes, pH control agents and mixtures thereof sufficient to make the receptacle of (A) water insoluble/indispersible in the volume of wash water in which it is used; and (D) a second closed, flexible receptacle, at least a part of one wall of said receptacle comprising a water soluble/dispersible or porous, water insoluble/indispersible material, said second receptacle enclosing the receptacle of (A) and component (C).

2. An article according to claim 1 wherein at least a part of one wall of the receptacle of (D) is porous and is selected from the group consisting of open cell foams and nonwoven materials.

3. An article according to claim 2 wherein the two receptacles are in the form of pouches.

4. An article according to claim 3 wherein both walls of the pouch of (A) are made of a water soluble/dispersible material.

5. An article according to claim 4 wherein both walls of the pouch of (D) are made of a material selected from the group consisting of open cell foams and nonwoven materials.

6. An article according to claim 5 wherein the fabric conditioning composition is a fabric softener/antistat composition.

7. An article according to claim 6 wherein the fabric softener/antistat composition contains a fabric softener-/antistat agent selected from the group consisting of cationic agents, nonionic agents and mixtures thereof.

8. An article according to claim 7 wherein the fabric softener/antistat composition contains a mixture of ditallowdimethylammonium methylsulfate and 1-methyl-1-[(tallowamide)ethyl]-2-tallowimidazolinium methylsulfate in a ratio of from about 65:35 to about 35:65.

9. An article according to claim 8 wherein the fabric softener/antistat composition additionally contains sorbitan tristearate in a ratio of from about 50:50 to about 5:95, sorbitan tristearate to the total amount of ditallowdimethylammonium methylsulfate and 1-methyl-1-[(tallowamide)ethyl]-2-tallowimidazolinium methylsulfate.

10. An article according to claim 5 wherein both walls of the pouch of (D) are nonwoven polyester materials and the walls of the pouch of (A) are made of a material selected from the group consisting of polyvinyl alcohol, gelatin and other proteins.

11. An article according to claim 10 wherein both walls of the pouch of (A) are polyvinyl alcohol having a degree of hydrolysis of from about 86% to about 98%.

12. An article according to claim 11 wherein component (C) is an electrolyte selected from the group consisting of sodium borate, sodium metaborate, ammonium sulfate, sodium sulfate, potassium sulfate, zinc sulfate, cupric sulfate, ferrous sulfate, magnesium sulfate, aluminum sulfate, potassium aluminum sulfate, ammonium nitrate, sodium nitrate, potassium nitrate, aluminum nitrate, sodium chloride, potassium chloride, sodium phosphate, potassium chromate, potassium citrate, sodium carbonate, potassium carbonate, and mixtures thereof.

13. An article according to claim 12 wherein the electrolyte is selected from the group consisting of sodium borate, sodium metaborate and mixtures thereof.

14. An article according to claim 13 wherein said article contains the fabric softener/antistat composition of claim 9.

15. An article according to claim 1 wherein the receptacle of (A) is in the form of a coating which is present on individual or agglomerated particles of the fabric conditioning composition of (B).

16. A process for conditioning fabrics comprising the following steps:

(A) adding to a clothes washer, containing fabrics and a normal amount of a detergent, a fabric conditioning article comprising:

1. a closed receptacle, at least a part of one wall of said receptacle comprising a water soluble/dispersible material;
2. an effective amount of a fabric conditioning composition, said composition being contained within the receptacle of (1);
3. an amount of an agent selected from the group consisting of electrolytes, pH control agents and mixtures thereof sufficient to make the receptacle of (1) water insoluble/indispersible in the volume of wash water in which the article is used; and
4. a second closed, flexible receptacle, at least a part of one wall of said receptacle comprising a water soluble/dispersible or porous, water insoluble/indispersible material, said second receptacle enclosing the receptacle of (1) and component (3); and (B) operating said washer at normal operating conditions through the wash and rinse cycles.

17. A process according to claim 16 wherein the following steps are added:

(C) the washed fabrics and fabric conditioning article from step (B) are transferred to a clothes dryer; and (D) said dryer is operated for an effective period of time at dryer operating conditions.

18. A process according to claim 17 wherein at least a part of one wall of the receptacle of (4) is porous and is selected from the group consisting of open cell foams and nonwoven materials.

19. A process according to claim 18 wherein the two receptacles are in the form of pouches.

20. A process according to claim 19 wherein both walls of the pouch of (1) are made of a water soluble/-dispersible material and both walls of the pouch of (4) are selected from the group consisting of open cell foams and nonwoven materials.

21. A process according to claim 20 wherein the fabric conditioning composition is a fabric softener/antistat composition said composition containing a fabric softener/antistat agent selected from the group consisting of cationic agents, nonionic agents and mixtures thereof.

22. A process according to claim 21 wherein the walls of the pouch of (1) are made of a material selected from the group consisting of polyvinyl alcohol, gelatin and other proteins.

23. A process according to claim 22 wherein the walls of the pouch of (1) are made of polyvinyl alcohol and the walls of the pouch of (4) are made of a polyester nonwoven material.

24. A process according to claim 23 wherein component (3) is an electrolyte selected from the group consisting of sodium borate, sodium metaborate and mixtures thereof.

25. A process according to claim 24 wherein the fabric softener/antistat composition contains a mixture of ditallowdimethylammonium methylsulfate and 1-methyl-1-[(tallowamide)ethyl] imidazolinium methylsulfate in a ratio of from about 65:35 to about 35:65 and sorbitan tristearate in a ratio of from about 50:50 to about 5:95, sorbitan tristearate to the total amount of ditallowdimethylammonium methyl sulfate and 1-methyl-1-[(tallowamide) ethyl]-2-tallow imidazolinium methylsulfate.

* * * * *

UNITED STATES PATENT AND TRADEMARK OFFICE

CERTIFICATE OF CORRECTION

PATENT NO. : 4,082,678

DATED : April 4, 1978

INVENTOR(S) : Hans J. Pracht and Louis F. Wong

It is certified that error appears in the above-identified patent and that said Letters Patent are hereby corrected as shown below:

At Col. 9, lines 11-21, the formula:

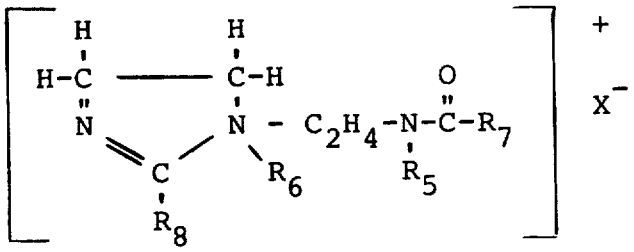

should be:

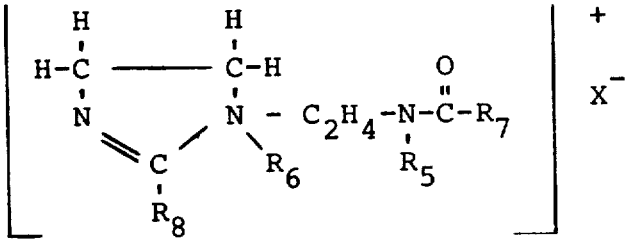

Signed and Sealed this

Third Day of July 1979

[SEAL]

Attest:

Attesting Officer

LUTRELLE F. PARKER

Acting Commissioner of Patents and Trademarks